United States Patent [19]

Korte et al.

[11] Patent Number: 4,517,992

[45] Date of Patent: May 21, 1985

[54] TOBACCO CONDITIONING APPARATUS

[75] Inventors: Kevin R. Korte; Daniel D. Snyder, both of Louisville, Ky.

[73] Assignee: Brown & Williamson Tobacco Corporation, Louisville, Ky.

[21] Appl. No.: 608,842

[22] Filed: May 10, 1984

[51] Int. Cl.[3] ..... A24B 3/04; A24B 9/00

[52] U.S. Cl. ..... 131/304; 131/306; 34/109

[58] Field of Search ..... 131/84 C, 290, 300–306; 34/109, 106, 46

[56] References Cited

U.S. PATENT DOCUMENTS 1,961,314 6/1954 Wall ..... 34/109

3,760,816 9/1973 Wochnowski ..... 131/305

*Primary Examiner*—V. Millina

*Assistant Examiner*—Harry Macey

*Attorney, Agent, or Firm*—Charles G. Lamb

[57] ABSTRACT

A tobacco treating apparatus including an outer, rotatable, hollow drum having a tobacco inlet at one end and a tobacco outlet at the opposite end with an inner, hollow drum extending through the tobacco inlet end, generally coaxial with the outer drum and extending a distance longitudinally into the outer drum a distance less than the entire length of the outer drum. The outer and inner drums cooperate to define an annular gas flow-through passageway which is open to an exhaust chamber. Tobacco to be treated is introduced into the inner drum and flows therefrom into the outer drum while a stream of tobacco treating gas is introduced into the tobacco outlet end to flow in counter-current direction to the flow of tobacco through the outer drum so that virtually all of the tobacco is contacted and treated by the gas. The treating gas leaves the outer drum through the annular flow-through passageway and into the exhaust air chamber from which it is exhausted from the apparatus. Baffles are located in the annular flow-through passageway to define a sinuous path to be followed by the gas in traversing the annular passageway in order to separate entrained particulate material from the treating gas before the treating gas enters the exhaust chamber.

20 Claims, 8 Drawing Figures

TOBACCO CONDITIONING APPARATUS

BACKGROUND OF THE INVENTION

1. Field of the Invention

The present invention is directed to apparatus for conditioning tobacco, and more particularly to an apparatus for treating tobacco with a gas.

2. Description of the Prior Art

It is well known to condition tobacco with a gas in order to, for example, cool tobacco, heat tobacco, or moisturize tobacco.

The following U.S. patents are exemplary of the prior art.

U.S. Pat. No. 187,187 issued on Feb. 6, 1877 shows one such apparatus which has an inclined rotating drum having a tobacco inlet at the elevated end in order to separate particulate material from the treating gas. An atomizing nozzle is located at the lower end of the drum to direct a stream of tobacco treating material such as steam or into the tobacco out end of the drum to pass in counter-current flow to the tobacco through the drum.

U.S. Pat. No. 436,032 shows an apparatus for treating tobacco which includes an inclined, hollow drum having a tobacco feed tube located at the elevated end and a tobacco discharge opening at the lower end. The drum has a plurality of longitudinally extending hollow perforated blades. Tobacco is introduced into the drum through the feed tube and is tumbled as it moves in the drum toward the discharge opening. A treating gas is introduced into the hollow blades, and exits the hollow blades through the perforations to contact the tumbling tobacco therein.

U.S. Pat. No. 483,401 shows an apparatus for preparing tobacco which includes a hollow (rotatable) cylinder provided with screw flanges with a tobacco inlet opening at one end. THe end of the cylinder opposite the tobacco inlet end is formed as a converging funnel. A plurality of pens extend generally radially into the converging funnel. The end of the funnel is open to provide an outlet for treated tobacco. A steam nozzle is located at the tobacco inlet end of the cylinder to inject tobacco treating steam into the cylinder in concurrent flow with the flow of tobacco through the cylinder.

U.S. Pat. No. 687,308 shows another apparatus for treating tobacco which having an inclined rotatable cylinder or drum having a plurality of pens radially projecting inwardly. Tobacco to be treated is introduced into the cylinder at its lower end along with a treating gas. The elevated upper end has a screen for separating particulates from the gas stream.

U.S. Pat. No. 2,799,278 shows a system for treating tobacco which includes an inclined rotating cylinder which has radially inwardly projecting pins. Tobacco to be treated is introduced into the elevated end of the cylinder, and a nozzle injects steam into the elevated end of the cylinder. As the tobacco and steam move from the elevated end to the lower end of the cylinder, the tobacco is softened by the steam and action of the pins projecting from the cylinder walls.

U.S. Pat. No. 3,409,025 shows an apparatus for treating tobacco which includes an inclined rotatable cylindrical drum which has an open tobacco inlet at its elevated end and an open tobacco outlet at its lower end. A heated air nozzle is located at the elevated tobacco inlet to direct heated air into the drum in concurrent flow with the flow of tobacco through the drum. The drum includes heating coils which extend in a longitudinal direction of the drum. The heating coils function to heat the tobacco within the drum as well as to act as blades to agitate the tobacco moving from the elevated end to the lower end of the drum.

U.S. Pat. No. 3,760,816 shows an apparatus for conditioning tobacco which includes an inclined, rotatable drum having a tobacco inlet at the elevated end and a tobacco outlet at the lower end. A hood is located over the elevated end and is connected to an exhaust fan. Treating gas is introduced at the lower tobacco exit end to introduce treating gas into the drum in counter-current flow to the flow of tobacco being treated. The drum is also equipped with heating coils which extend longitudinally of the drum. The coils function to heat the tobacco as well as tumble the tobacco.

SUMMARY OF THE INVENTION

The present invention is directed toward a tobacco treating device having coaxially disposed rotatable drums in which the tobacco is treated by a treating gas including maintenance free means for separating entrained particulates from the treating gas prior to the point of exhaust of the treating gas from the device.

The present invention further provides a tobacco treating device of the class described including means for adjusting the treating gas velocity and velocity profile in the treating drum.

More particularly, the present invention provides a tobacco conditioning apparatus for conditioning tobacco with a gas comprising an outer rotatably mounted, hollow cylindrical drum having a tobacco entrance at one end and a tobacco outlet at the opposite end; an inner, hollow cylindrical drum coaxially located within the outer drum and extending through the tobacco entrance end of the outer drum a predetermined distance less than the entire length of the outer drum, the inner drum being attached to the outer drum for rotation therewith; an annular treating gas flow-through passageway defined between the outer drum and inner drum; and means located within the annular treating gas flow-through passageway defining a sinuous gas flow path through the passageway.

BRIEF DESCRIPTION OF THE DRAWINGS

These and other advantages and features of the present invention will become more clearly upon reference to the following description in conjunction with the drawings in which like numerals refer to like parts and wherein.

DETAILED DESCRIPTION OF THE PREFERRED EMBODIMENTS

Figure 1:
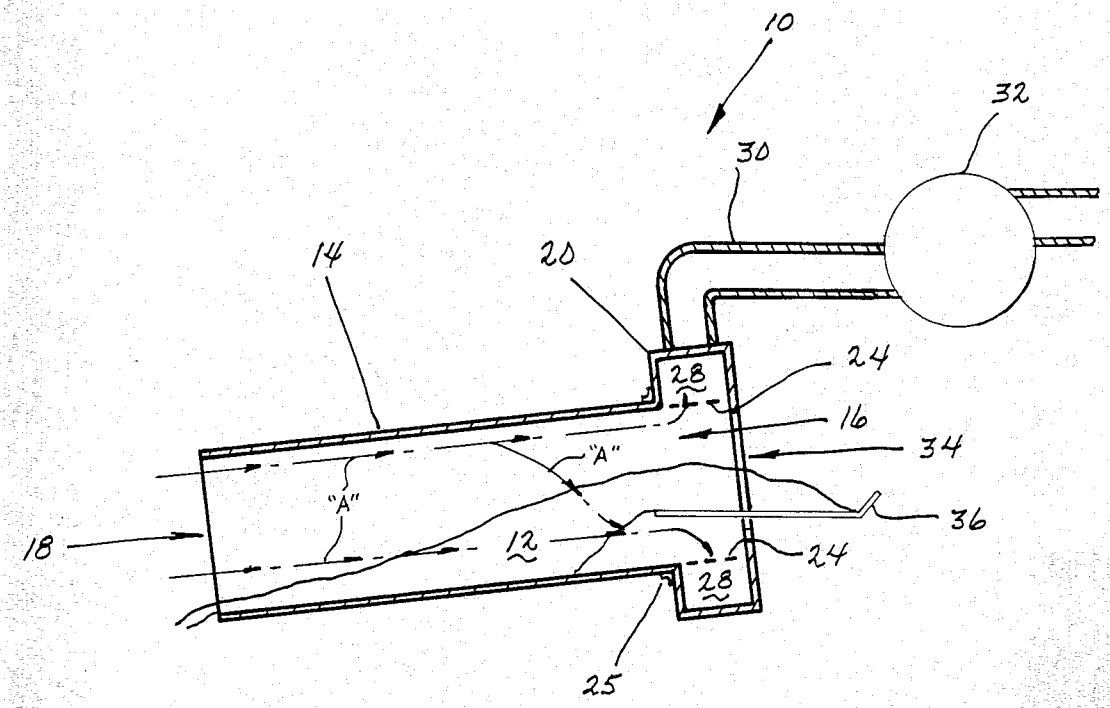
FIG. 1 is a longitudinal cross-sectional view of a typical prior art tobacco conditioning apparatus.

FIG. 1 illustrates an example of a prior art tobacco conditioning apparatus, generally denoted as the numeral 10, for conditioning tobacco particles 12. It should be understood that the term conditioning is meant to include, but is not limited to, heating, drying, cooling and moisturizing tobacco. The tobacco conditioning apparatus 10 includes a hollow cylindrically shaped drum 14 having an open tobacco entrance end 16 and an open tobacco exit end 18. The drum 14 is inclined at an angle to the horizontal such that the tobacco inlet end 16 is higher than the tobacco outlet end 18. Further, the drum 14 is mounted for rotational movement about its longitudinal axis by means (not shown) which are well known to the art, and for the sake of brevity will not be described. The apparatus 10 further includes an exhaust hood 20 located at the tobacco entrance end 16 of the drum 14 open to the tobacco inlet end 16 of the drum, thus, providing for fluid communication from the interior of the drum into the exhaust hood 20. As shown, the exhaust hood 20 is generally cylindrical in shape, of a larger diameter than the drum 14, and is disposed in coaxial relationship to the drum 14. The exhaust hood 20 is held in a fixed position by appropriate framework (not shown), and has a peripheral seal 25 which contacts the periphery of the drum 14 to prevent treating gases from leaking out of the apparatus 10 through the juncture of the drum 14 and hood 20. A cylindrical screen structure 24 of generally the same diameter as the drum 14 is located within the exhaust hood 20 generally coaxial with the drum 14 and cooperating with the exhaust hood 20 to define a generally annular exhaust exit chamber 28 concentric with the drum 14. An exhaust gas conduit 30 is in gas flow communication with the annular exhaust exit chamber 28. Typically, an exhaust or suction fan 32 is operatively located within the exhaust duct 30 to create a gas flow through the tobacco exit end 18 of the drum 14, along the interior of the drum 14, into the exhaust hood 20 through the screen structure 24 into the annular exhaust exit chamber 28 and out through the exhaust gas duct 30. The exhaust hood 20 includes an opening 34 generally in line with the tobacco entrance 16 of the drum 14. A tobacco conveying means, 36, such as a vibrating conveyor is disposed through the opening 34 in the hood 20 and into the tobacco entrance 16 of the drum 14.

In operation, tobacco particles 12 to be conditioned are fed into the interior of the drum 14 by the conveyor means 36 extending through an appropriate opening 34 in the exhaust hood 20 and into the drum 14 through tobacco entrance end 16 of the drum 14. The tobacco flows in the rotating drum 14 to the tobacco outlet end 18 and out of the drum. Conditoning gas, for example, air is drawn into the interior of the drum 14, as described above, by the suction fan 32 and flows countercurrent to the flow of tobacco particles 12, as indicated by the flow arrows "A". As the conditioning gas flows through the drum 14, it contacts the tobacco particles 12 flowing in the other direction through the drum, thus, conditioning the tobacco particles 12. As the conditioning gas flows through the screen structure 24, any entrained particles are separated from the gas. The problem is that the screen structure 24 becomes clogged with separated tobacco particles and dust, with the result that the apparatus 10 must be frequently shutdown in order to clean the screen structure 24. The use of a larger screen size lessens the clogging problem, but allows excessive particles to pass through into the exit chamber 28 and, hence, into the atmosphere.

Figure 2:
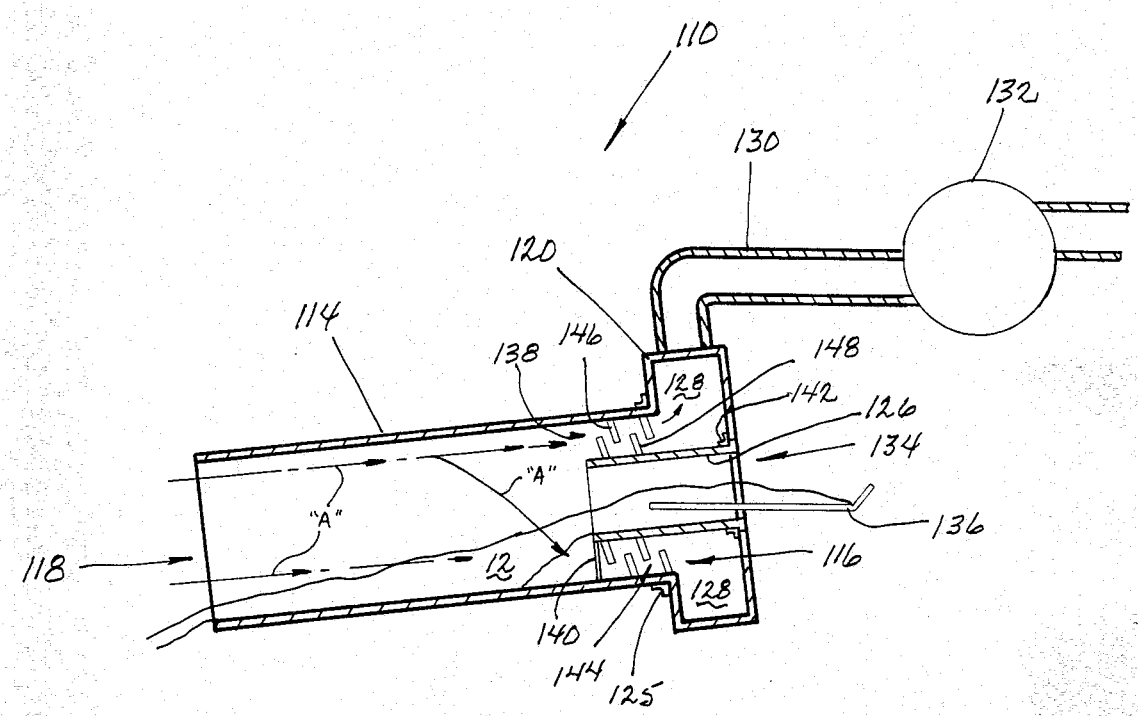
FIG. 2 is a longitudinal cross-sectional view of a tobacco conditioning apparatus of the present invention.

Now, with reference to FIG. 2, there is shown a tobacco conditioning apparatus of the present invention, generally denoted as the numeral 110, which provides a solution to the above discussed problem.

Figure 3:
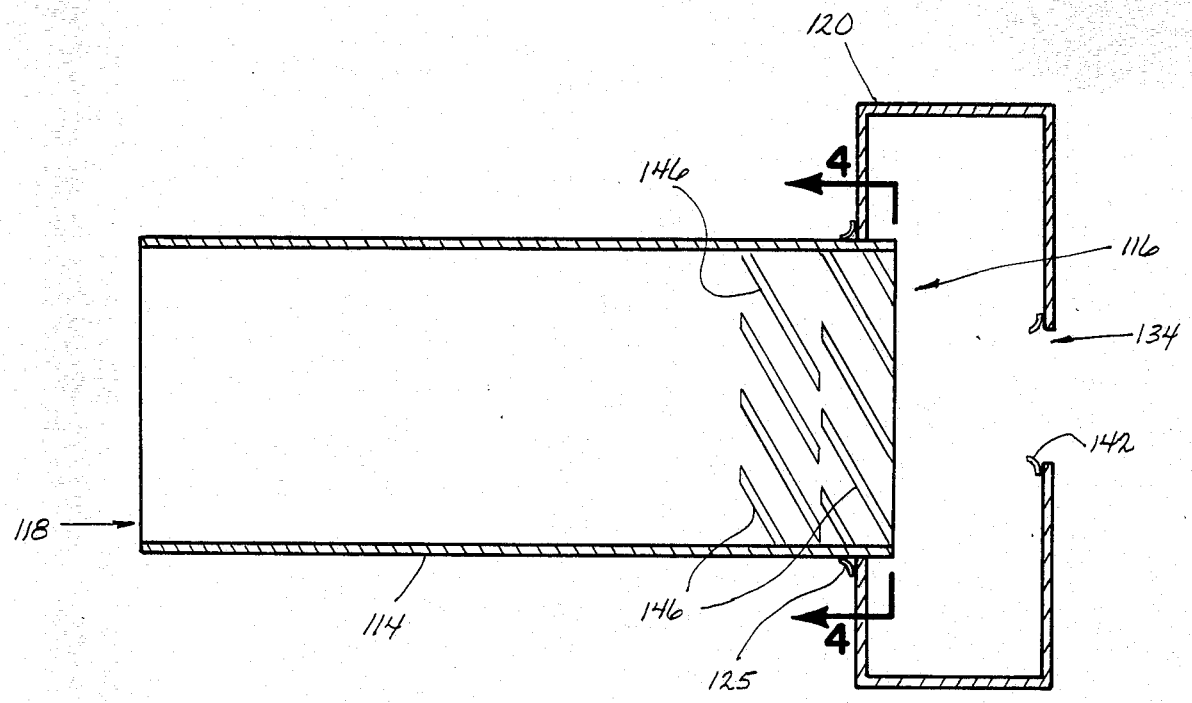
FIG. 3 is an enlarged longitudinal cross-sectional view of a component of the apparatus of FIG. 2.
Figure 4:
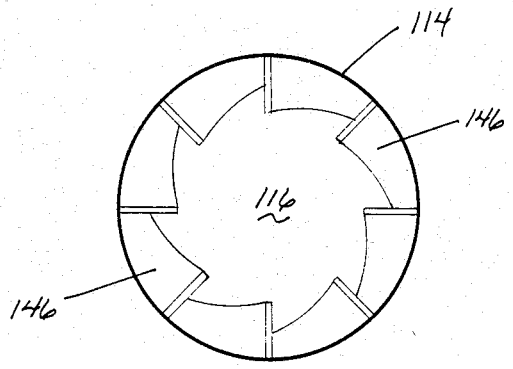
FIG. 4 is an end view of the component of FIG. 3 as viewed in the direction of arrows 4—4 in FIG. 3.
Figure 5:
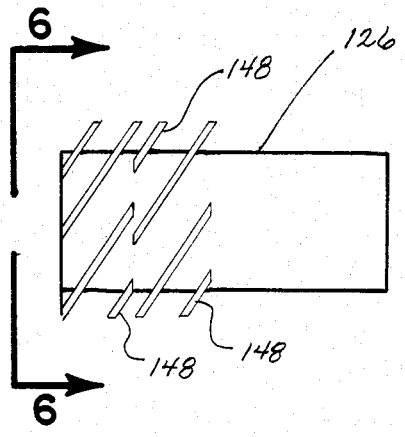
FIG. 5 is an enlarged longitudinal view of another component of the apparatus of FIG. 2.
Figure 6:
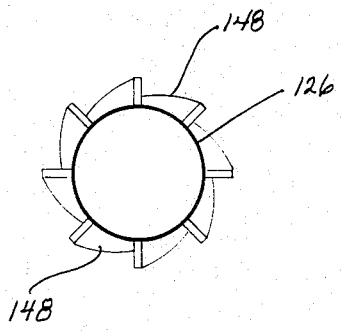
FIG. 6 is an end view of the component of FIG. 5 as viewed in the direction of arrows 6—6 in FIG. 5.

The apparatus 110 of the present invention includes a hollow cylindrically shaped drum 114 having an open tobacco entrance end 116 is higher than the tobacco outlet end 118. The drum 114 is mounted for rotation about its longitudinal axis by means (not shown) which are well known in the art, and do not form part of the present invention, and, therefore, for the sake of brevity will not be described. The apparatus 110 also includes an exhaust hood 120 located at the tobacco entrance end 116 of the drum 114 defining an exhaust plenum 128 open to the tobacco entrance end 116 of the drum 114. As shown, the exhaust hood 120 is generally cylindrical in shape, of a larger diameter than the drum 114, and is disposed in coaxial relationship to the drum 114. The hood 120 is held in a fixed position by appropriate framework (not shown), and has a peripheral seal 125 which contacts the periphery of the drum 114 to prevent treating gas from leaking out of the apparatus at the juncture of the drum 114 and hood 120. An exhaust gas conduit 130 is in gas flow communication with the interior of the exhaust hood 120. Typically, an exhaust or suction fan 132 is operatively located within the exhaust duct 130 to create a gas flow through the drum 114 from the tobacco outlet end 118 to the tobacco inlet end 116 of the drum 114. The exhaust hood 120 includes an opening 134 generally in line with the tobacco entrance 116 of the outer drum 114. A tobacco conveying means 136, such as a vibrating conveyor is disposed through the opening 134 in the hood 120 and into the tobacco entrance 116 of the drum 114. The apparatus 110 also includes an inner drum 126 of a smaller diameter than the outer drum 114, and is located in coaxial relationship to the outer drum 114. The inner drum 126 extends from the inlet opening 134 of the hood 120 through the open tobacco inlet end 116 of the drum 114 a predetermined longitudinal distance into the outer drum 114 less than the entire length of the outer drum 114. The exterior peripheral surface of the portion of the inner drum 126 extending through the exhaust hood 120 cooperates with the adjacent walls of the exhaust hood 120 to define an annular exhaust chamber 128. The exterior peripheral wall surface of the portion of the inner drum 126 interior of the outer drum 114 cooperates with the interior peripheral surface of the outer drum 114 to define an annular flow through treating gas passageway 138 from the interior of the outer drum 114 into the annular exhaust chamber 128. The inner drum 126 is attached to the outer drum 114 by, for example, web structures 140 so that the inner drum 126 will rotate with the outer drum 114. In addition, a peripheral seal 142 is attached to the exhaust hood 120 around the inlet opening 134 therethrough and contacts the periphery of the inner drum 126 to prevent treating gas from leaking out of the annular exhaust chamber 128 at the juncture of the inner drum 126 and exhaust hood 120. Preferably, the annular flow through passageway 138 includes means, generally denoted as the numeral 144, to create a sinuous gas flow path through the annular passageway 138. As can be best seen in FIGS. 3, 5 and 7, the sinuous path defining means 144 comprises first baffles 146 extending from the interior surface of the outer drum 114 into annular passageway 138 toward the exterior surface of the inner drum 126, and second baffles 148 extending from exterior surface of the inner drum 126 into the annular passageway 138 toward the interior surface of the outer drum 114. The first baffles 146 preferably extend generally radially into the annular passageway 138 about one-half the radial distance between the inner and outer drums, and the second baffles 148 preferably extend radially into the passageway 138 about one-half the radial distance between the inner and outer drums. The first baffles 146 are generally equally spaced apart from each other circumferentially of the outer drum 114, and the second baffles 148 are generally equally spaced apart from each other circumferentially of the inner drum 126. In addition, the first baffles 146 and second baffles 148 are in staggered relationship to each other such that each first baffle 146 extends into the space between a different two adjacent second baffles 148 and, similarly, each second baffle 148 extends into the space between a different two adjacent first baffles 146. Further, it is preferable that the first baffles 146 are each in the form of a helix extending generally longitudinally of the outer drum 114 having, for example, a right-hand or clockwise twist, and that the second baffles 148 are each in the form of a helix extending generally longitudinally of the inner drum 126 having a counter curved direction to the first helical baffles 146, for example, a left-hand or counterclockwise twist. This relationship can be seen in comparing FIG. 4 to FIG. 6 and in FIG. 7. In longitudinal cross-section, the counter-helical first and second baffles produce a crossing pattern of open flow areas within the annular passageway 138 which the flow of treating must traverse, thus, causing a turbulent treating gas flow in the annular passageway 138. Preferably, the first helical baffles 146 have a helical twist in the direction of the rotation of the outer drum 114. That is, assuming the outer drum 114 is rotating in a clockwise direction as viewed from the drum tobacco outlet end 118, the first helical baffles 146 would also have a right-hand or clockwise twist. By the same token, if the outer drum 114 is rotating in a counterclockwise direction, the first baffles 146 would have a left hand or counterclockwise twist.

Further, the upstream surface of a portion of each of the first baffles 146 (relative to the direction of flow of gas through the annular passageway 138) is oriented at an obtuse angle to the general direction of the gas flow, and the upstream surface of second baffles 148 is oriented at an acute angle to the general direction of the gas flow.

It is also preferable, that the diameter of the inner drum 126 should be as small as practically possible in a particular installation so as to maximize the cross-sectional gas flow area of the annular passageway 138 through which the treating gas flows in order to minimize the increase in treating gas velocity as the gas flows from the outer drum 114 into the annular passageway 138. Ideally, the cross-sectional flow area of the annular passageway 138 should be such that the treating gas velocity flowing through the annular passageway 138 is less than the fluidization velocity of the tobacco particles being treated in the apparatus, thus, reducing the carry-over of tobacco particles in the treating gas stream entering the annular passageway 138.

Figure 7:
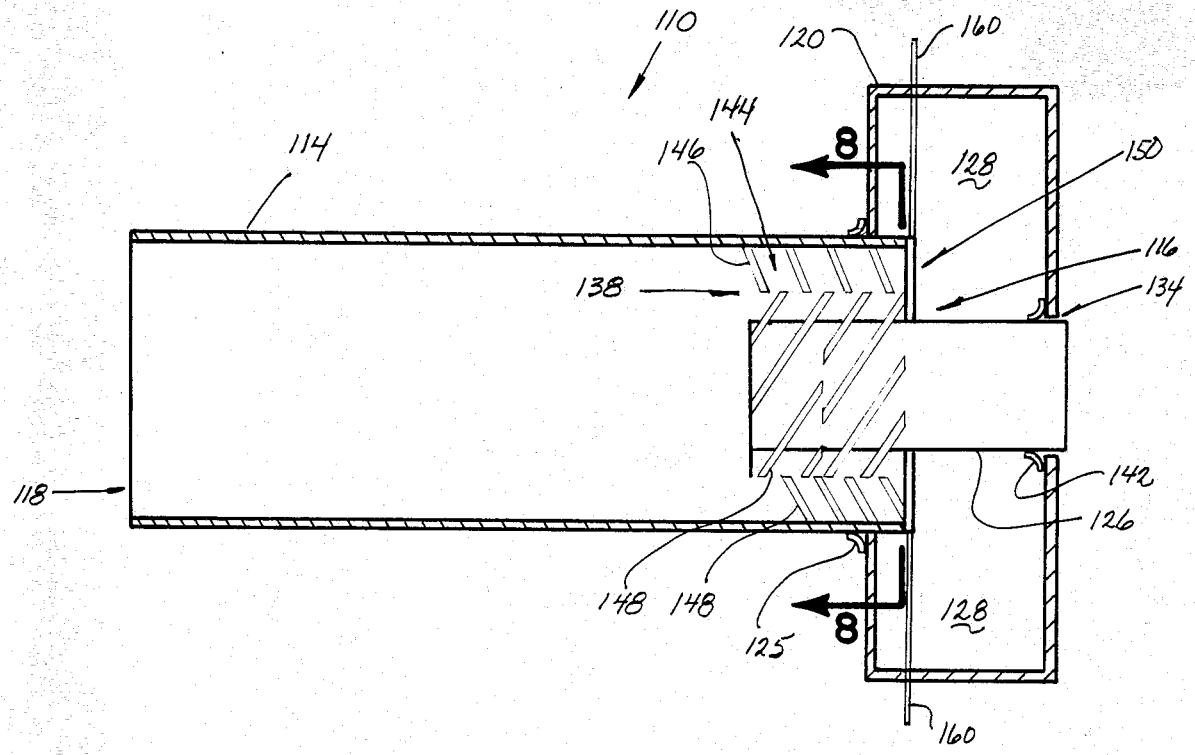
FIG. 7 is an enlarged longitudinal cross-sectional view of the apparatus of FIG. 2 showing an additional feature of the present invention; and, FIG. 8 is an end view of the additional feature as viewed in the direction of arrows 8—8 in FIG. 7.
Figure 8:
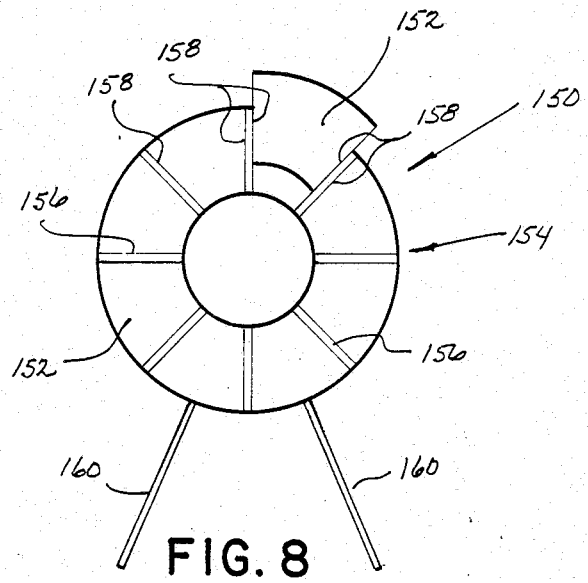

FIGS. 7 and 8 depict the apparatus 110 including the additional feature of treating gas velocity control means, generally denoted as the numeral 150, located at the outlet from the annular passageway 138 into the exhaust chamber 128. As shown, the velocity control means 150 comprises an annular assembly of individually movable plates 152 selectively positioned to open and close segments of the annular gas outlet from the annular passageway 138. FIG. 8 depicts the plates 152 as being generally wedge-shaped, each covering a 45 degree segment of the annular passageway 138 outlet. The plates 152 are housed in, for example, a framework, generally denoted as the numeral 154, which includes a plurality of radially extending webs 156, equally spaced apart circumferentially of the outlet of the annular passageway 138. Each of the webs 156 can be, for example, attached at one end to the wall of the inner drum 126 and at the opposite end to the wall of the outer drum 114. In transverse cross-section, the webs 156 can be, for example, H-shaped to provide channels 158 to cage the movable plates 152 while allowing the plates to be moved in a generally radial direction of the outlet from the annular passageway 138 to selectively cover or uncover selected areas of the outlet from the annular passageway 138. These plates can be moved in a number of ways. For example, a control rod 160 can be attached to each plate 152 and extend radially therefrom, through an appropriate aperture in the wall of the hood 120 to the outside of the apparatus. Thus, an operator can manually move each plate 152 individually in a generally radial direction of the annular passageway 138 by grasping the protruding end of a rod 160 and moving the rod in a longitudinal direction to move the attached plate radial to cover or uncover a portion of the outlet from the annular passageway 138.

In operation of the apparatus 110, tobacco particles 12 to be conditioned are fed into the interior of the rotating inner drum 126 by the conveyor means 136 extending through the opening 134 in the exhaust hood 120. The tobacco particles 12 flow in the rotating inner drum 126 in the direction toward the open tobacco outlet 118 of the outer rotating drum and exits the inner drum 126 into the outer drum 114. The tobacco particles 12 continue to flow in the rotating outer drum 114 and leaves the outer drum 114 through the open tobacco outlet 118. Conditioning gas, for example, air is drawn into the outer rotating drum 114 through the open tobacco outlet 118 of the outer drum 114 and flows in a counter-current direction to the flow of tobacco particles 12, as indicated by the flow arrows "A", thus, contacting and conditioning the flow of tobacco particles 12 and conditioning tobacco. After the conditioning gas has contacted and thereby conditioned it, the gas flows into the annular gas flow-through passageway 138 and traverses the sinuous path defined by the first and second means 146 and 148 as it flows through the annular passageway 138 toward the annular exhaust chamber 128. As the treating gas changes direction flowing the sinuous path through the annular flow-through passageway 138, entrained particulate material is separated by centrifugal force and by impaction upon the first and second baffles 146 and 148. Due to the orientation of the first and second baffles 146 and 148, respectively, relative to the direction of rotation of the outer drum 114 and direction of the gas flow, and the downwardly inclined orientation of the apparatus 110 the particulate material separated from the treating gas in the annular passageway 138 is directed back toward the outer rotating drum 114. The new clean treating gas in the annular exhaust chamber 128 flows out through the exhaust gas conduit 130. With reference to the apparatus 110 of FIG. 7, the velocity of the treating gas as well as the velocity profile of the treating gas flowing through the annular gas flow-through passageway 138 can be adjusted to provide for efficient particulate matter separation therein by moving selected velocity control plates 152 to cover and uncover selected amounts of the outlet area of the annular flow-through passageway 138.

Thus, particulate matter is effectively separated from the treating gas stream without the use of a separating media, such as a screen, thereby eliminating the problems attendant with such a separating media.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. A tobacco conditioning apparatus for conditioning tobacco with a gas comprising:

an outer rotatably mounted, hollow cylindrical drum having a tobacco entrance at one end and a tobacco outlet at the opposite end;

an inner, hollow cylindrical drum coaxially located within the outer drum and extending through the tobacco entrance of the outer drum a predetermined distance less than the entire length of the outer drum, the inner drum interior defining the sole means for receiving tobacco into the conditioning apparatus, the inner drum being attached to the outer drum for rotation therewith;

an annular treating gas flow-through passageway defined between the outer drum and the inner drum; and, means located within the annular treating gas flow-through passageway defining a sinuous gas flow path through the passageway.

2. The tobacco conditioning apparatus of claim 1, wherein the sinuous gas flow path defining means comprises baffle means projecting into the annular flow-through passageway.

3. The tobacco conditioning apparatus of claim 2, wherein the baffle means comprises:

first baffles extending from the interior surface of the outer drum into the annular passageway toward the exterior surface of the inner drum; and, second baffles extending from the exterior surface of the inner drum into the annular passageway toward the interior surface of the outer drum.

4. The tobacco conditioning apparatus of claim 3, wherein:

the first baffles extend generally radially into the annular passageway about one-half the radial distance between the inner and outer drums; and, the second baffles extend generally radially into the annular passageway about one-half the radial distance between the inner and outer drums.

5. The tobacco conditioning apparatus of claim 3, wherein:

the first baffles are generally equally spaced apart from each other circumferentially of the outer drum;

the second baffles are generally equally spaced apart from each other circumferentially of the inner drum; and, the first baffles and second baffles are in staggered relationship to each other.

6. The tobacco conditioning apparatus of claim 3, wherein:

each of the first baffles are in the form of a helix extending generally longitudinally of the outer drum; and, each of the second baffles are in the form of a helix extending generally longitudinally of the inner drum.

7. The tobacco conditioning apparatus of claim 6, wherein:

the first helical baffles have a twist in one direction; and, the second helical baffles have a twist in the opposite direction.

8. The tobacco conditioning apparatus of claim 6, wherein the first helical baffles have a twist in the direction corresponding to the direction of rotation of the outer drum.

9. The tobacco treating apparatus of claim 3, wherein:

the upstream surface of a portion of each of the first baffles is oriented at an obtuse angle to the general direction of gas flow through the annular passageway; and, the upstream surface of a portion of each of the second baffles is oriented at an acute angle to the general direction of gas flow through the annular passageway.

10. The tobacco conditioning apparatus of claim 1, wherein the cross-sectional flow area of the annular gas flow passageway is sized to maintain the velocity of the conditioning gas through the annular passageway is less than the fluidization velocity of the tobacco to be conditioned.

11. The tobacco conditioning apparatus of claim 1 further comprising adjustable conditioning gas velocity control means associated with the annular passageway for controlling the velocity of the gas flowing through the passageway.

12. The tobacco conditioning apparatus of claim 11, wherein the gas velocity control means is located at the outlet from the annular passageway.

13. The tobacco conditioning apparatus of claim 11, wherein the gas velocity control means comprises an annular assembly of individually movable plates located about the flow-through annular passageway.

14. The tobacco conditioning apparatus of claim 13, wherein each of the movable plates is adapted to be selectively positioned to open and close segments of the annular gas flow-through passageway.

15. The tobacco conditioning apparatus of claim 14, wherein the movable plates are adapted for movement radially of the annular flow-through passageway.

16. The tobacco conditioning apparatus of claim 15, wherein the movable plates further comprise means for selectively moving the plates from the exterior of the apparatus.

17. The tobacco conditioning apparatus of claim 1, further comprising means defining an exhaust gas chamber in gas flow communication with the annular flow-through passageway.

18. The tobacco conditioning apparatus of claim 17, wherein the inner drum extends through the exhaust gas chamber defining means.

19. The tobacco conditioning apparatus of claim 17 wherein the exhaust gas chamber defining means defines an annular exhaust chamber generally coaxial with the inner drum.

20. The tobacco conditioning apparatus of claim 17, further comprising means for creating a gas flow within the exhaust chamber.

* * * * *